US005170822A

United States Patent [19]

Josefsson et al.

[11] Patent Number: 5,170,822

[45] Date of Patent: Dec. 15, 1992

[54] YARN STORAGE AND FEED DEVICE WITH AXIALLY ADJUSTABLE YARN STOPPING ELEMENT

[75] Inventors: Pär Josefsson, Borås; Joachim Fritzson, Ulricehamn, both of Sweden

[73] Assignee: IRO AB, Ulricehamn, Sweden

[21] Appl. No.: 674,371

[22] PCT Filed: Oct. 5, 1989

[86] PCT No.: PCT/EP89/01165

§ 371 Date: Jun. 3, 1991

§ 102(e) Date: Jun. 3, 1991

[87] PCT Pub. No.: WO90/04057

PCT Pub. Date: Apr. 19, 1990

[30] Foreign Application Priority Data

Oct. 6, 1988 [DE] Fed. Rep. of Germany ..... 3834055

[51] Int. Cl.[5] ..... D03D 47/36

[52] U.S. Cl. ..... 139/452

[58] Field of Search ..... 139/452; 242/47.01

[56] References Cited

U.S. PATENT DOCUMENTS

| | | | |
|---|---|---|---|
| 4,529,017 | 7/1985 | Suzuki et al. | 139/452 |
| 4,792,101 | 12/1988 | Van Bogaert et al. | 139/452 |
| 4,949,763 | 8/1990 | Maina | 139/452 |

FOREIGN PATENT DOCUMENTS

| | | |
|---|---|---|
| 890082 | 2/1982 | Belgium . |
| 0098255 | 1/1984 | European Pat. Off. . |
| 0174039 | 3/1986 | European Pat. Off. . |
| 0264985 | 4/1988 | European Pat. Off. . |
| WO89/08600 | 9/1989 | PCT Int'l Appl. . |

*Primary Examiner*—Andrew M. Falik

*Attorney, Agent, or Firm*—Flynn, Thiel, Boutell & Tanis

[57] ABSTRACT

A yarn storage and feed device for textile machines, in particular for the weft yarn of a multicolor weaving machine, comprising an arrangement for limiting the length of the yarn which is unwound in sections having a predetermined length. The arrangement includes a cylindrical storage member for a yarn supply which consists of windings and from which the yarn can be unwound via one end of the cylinder. At least one stopping element is arranged at an axial distance from the last yarn winding of the yarn supply and is adapted to be moved from a passive position, in which the yarn unwound in a circulating movement passes the stopping element, to a stopping position, in which the yarn under take-off tension is stopped at the stopping element during a period of rest until the next movement of the stopping element to the passive position takes place. Depending on the yarn quality, the axial distance between the last winding (11') of the yarn supply (5) and the stopping element (13) is adapted to be adjusted to a maximum value ($A_{max}$) on the basis of which an axial migrating movement of the yarn (F) will be prevented in at least the last winding (11') and in the yarn section (12) between the last winding of the yarn supply and the stopping element (13) during the period of rest.

22 Claims, 2 Drawing Sheets

YARN STORAGE AND FEED DEVICE WITH AXIALLY ADJUSTABLE YARN STOPPING ELEMENT

BACKGROUND OF THE INVENTION

1. Field of the Invention

The present invention refers to a yarn storage and feed device.

2. Description of Prior Art

In the case of known yarn storage and feed devices, the stopping element is arranged at a comparatively large axial distance from the last winding of the yarn supply close to the head of the storage member. The position of the stopping element is chosen with due regard to the fact that all imaginable yarn qualities are to be processed by the yarn storage and feed device and that, when using the same length in the yarn supply for essentially all the yarn qualities, a substantial axial distance between the last winding in the yarn supply and the stopping element and a comparatively large angle between the last winding in the yarn supply and the yarn section moving from the last yarn winding to the stopping element still exist even in the case of the coarsest yarn. Especially when multicolor weaving is performed on a jet weaving machine, a group of such yarn storage and feed devices is provided, only one of said devices being in operation, whereas the others are at rest. However, the yarns of the yarn storage and feed devices which are at rest always extend up to and into the main nozzle of the weaving machine where they are permanently acted upon by a pressure medium flow and thus kept at hand for the next insertion process. In view of the fact that the main nozzle and the reed oscillate and the yarn is acted upon by the standby pulling force, at least the last winding will be axially opened in a manner comparable to a helical spring having a pulling force applied thereto, this being due to the large angle between the last winding and the yarn section extending towards the stopping element. This will cause an increase in the length of the yarn downstream of the stopping element so that the free end of the yarn moves out of the main nozzle. The cutting device, which is associated with the main nozzle and provided for all yarns and which is periodically actuated for the color which is just being processed, cuts off this increase in length. The resultant yarn pieces will not only cause uncontrollable interfering effects in this critical operating area but they will also penetrate into the woven fabric and deteriorate its quality.

It is true that, in the case of a yarn storage and feed device comprising several stopping elements which are distributed around the circumference of the storage member in spaced relationship with one another (EP 264985), it is known to axially displace the stopping elements during the yarn withdrawl and insertion process so as to be able to determine—in spite of the spaces between the individual stopping elements—precisely, without any discontinuity, the length of yarn to be inserted. This principle, however, does not take into account the processes taking place in the yarn supply in the period of rest and it cannot provide any suggestions with regard to the solution of the problem described at the beginning.

FIG. 1 and 2 disclose a yarn storage and feed device 1' having a known structural design, in the case of which components which are of secondary importance in understanding the function have been omitted. Such yarn storage and feed devices 1' are often used for multicolor weaving on jet weaving machines W so as to supply to the jet weaving machine W weft yarn sections of a precise length, said weft yarn sections being drawn off a supply bobbin (not shown) as a continuous yarn F. The exact dimensioning of every weft yarn section is effected with the aid of a means, which is not shown and which is incorporated into the yarn storage and feed device 1', said means including either, in the case of a cylindrical storage member 2 having an adjustable outer diameter, a single stopping element 13, which interrupts the yarn take-off process when a predetermined yarn length has been reached, or, in the case of a storage member having a fixed outer diameter, several stopping elements 13, which are distributed over the circumference of said storage member at regular intervals and which are used for interrupting the yarn take-off process at a respective stopping element 13 which has been selected. This principle is, however, known so that there is no need of discussing it in the present connection.

In addition to the e.g. non-rotatably fixed storage member 2, which defines a storage surface 4 and the axis of which is provided with reference numeral 3, the yarn storage and feed device 1' is equipped with a winding element 5 which is adapted to be caused to rotate by means of a drive motor 6. The winding element 5 is hollow so that the yarn F coming from the bobbin is guided in the interior of said element along the axis 3 and then radially outwards to a location where it is spirally wound onto the storage surface 4 in successive windings 11 in a yarn supply S. The drive motor 6 is connected to a control device 7, which is, in turn, connected to a maximum sensor 8 and a minimum sensor 9 through a control line 10. If desired, the minimum sensor 9 can also be omitted. The two sensors 8, 9 are responsible for actuating and deactuating the drive motor 6 in such a way that, when the size of the yarn supply S falls below a specific limit, the drive motor 6 will be energized unitl the maximum sensor 8 detects the necessary size of the yarn supply S and deenergizes the drive motor 6.

In the yarn supply S, the individual windings 11 are positioned side by side. The last winding 11' faces the stopping element 13, which is located at a comparatively large axial distance A from the yarn supply S.

The stopping element 13 is adapted to be moved between a passive position, in which the yarn F can be unwound unhindered and with a circulating movement around the storage surface 4 and its head, and a stopping position (FIG. 1 and 2), in which the yarn is prevented from carrying out the circulating take-off movement and is deflected via the stopping element 13. On its path leading to the weaving machine W, the yarn F is then redeflected towards the axis 3 via the head of the storage member 2 prior to running through a yarn eye 14 and from said yarn eye into a passage **15*a* of a main nozzle 15 of the weaving machine W. The main nozzle 15, which is connected to a pressure medium supply, is attached to the reed (not shown) at the inlet to the shed in such a way that it will be oscillatingly moved together with the reed in the course of the reciprocating movement of said reed (double arrow 17). The main nozzle 15 includes a number of passages corresponding to the number of colors which are being processed; in the present case, it includes the passage 15*a* for the yarn F and a passage 15b for a second yarn F″ which is just being processed and which comes from a yarn eye 16**.

In the case of multicolor weaving, the weaving machine W has associated therewith a number of yarn storage and supply devices 1′ corresponding to the number of colors. The yarn storage and feed device 1′ with the color (yarn F) which is not being processed at the moment is at rest (FIG. 1 and 2). During the period of rest, the passage 15a is acted upon by a pressure medium flow, which applies to the yarn F a permanent standby pulling force P (i.e. take-off tension) in the direction of the shed and which keeps said yarn F straight. The free end F′ of the yarn F projects beyond the main nozzle up to and into the area of a cutting device 18, which is common to all yarns processed and which, when the reed is moving, is periodically actuated, e.g. for the purpose of cutting the yarn F″. The free end F′ of the yarn F projects beyond the main nozzle 15 by a length L.

FIG. 1 shows the commencement of the period of rest of the device 1′. The other yarn F″ is just being inserted. The section 12 of the yarn F and the last winding 11′, which is located directly adjacent the windings 11 in the yarn supply S, include an angle $\alpha$. The standby pulling force P is permanently effective.

Due to the standby pulling force P and due to the oscillating movement (double arrow 17) of the main nozzle 15, an axially directed force component resulting from the standby pulling force and its oscillation becomes effective in the yarn F, said force component starting to gradually open—according to FIG. 2—at least the last winding 11′, similar to a helical spring having an axial tension load applied thereto. The major part of at least the last winding 11′ starts to migrate gradually towards the stopping element 13. Due to this migrating movement and in view of the fact that the bend between the section 12 and the last winding 11′ stretches and forms an (in the layout of the storage surface 4) essentially straight line, the free end F′ of the yarn F will migrate further out of the main nozzle 15 and into the shed, the distance along which said migration takes place being the distance L1. This increase in length will, however, have the effect that in the case of the next actuation of the cutting device 18 for the purpose of cutting to length a section of the yarn F″ which is just being processed, a piece x of the yarn F will be cut off which will drop freely or which will be carried into the shed. These free yarn pieces x arise from each yarn during the period of rest and this will progressively result in a strong contamination of the insertion inlet and in uncontrollable faults of the woven fabric.

SUMMARY OF THE INVENTION

The present invention is based on the task of providing a yarn storage and feed device of the type mentioned at the beginning by means of which malfunctions in the yarn insertion process and a loss of quality in the finished woven fabric due to uncontrollable pieces of yarn are avoided.

In the present invention, the axial distance between the stopping element and the last winding of the yarn supply can be adjusted in response to the yarn quality or rather the yarn thickness in such a way that the oscillating pulling force in the yarn is no longer able to open the last yarn winding and perhaps also additional yarn windings in the period of rest. The force component resulting from the pulling force in the yarn and effective in the yarn section between the last winding and the stopping element in the axial direction is no longer strong enough for displacing the yarn during the period of rest. Notwithstanding the fact that the cutting device is periodically actuated, the free end of the yarn is no longer cut off in the period of rest so that the cut-off ends can no longer cause any malfunctions nor any loss of quality in the woven fabric.

BRIEF DESCRIPTION OF THE DRAWINGS

An embodiment of the subject matter of the invention is explained on the basis of the drawings in which.

DETAILED DESCRIPTION

Figure 3:
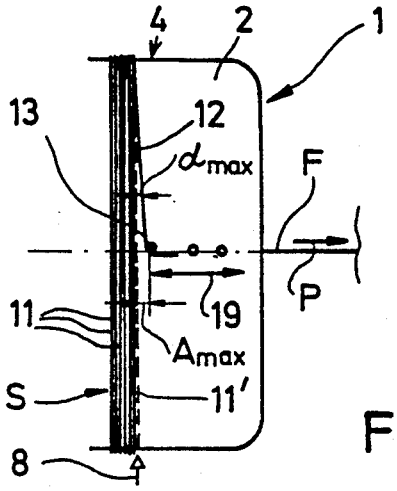
FIG. 3 shows a top view of a yarn storage and feed device according to the present invention, which corresponds to the top view of FIG. 1 and 2.

In accordance with the present invention, the production of these undesirable and uncontrollable yarn pieces x is avoided in the case of a yarn storage and feed device 1 according to FIG. 3 by providing the feature that the stopping element 13 is adapted to be adjusted towards the yarn supply S in the direction of the double arrow 19 and in the axial direction of the storage member 2 until the axial distance between the stopping element 13 and the last winding 11′ has a maximum value $A_{max}$, which guarantees that the angle between the last winding 11′ and the section 12 of the yarn F will not exceed a maximum value $\alpha_{max}$ in the case of which the axial component resulting from the standby pulling force P will no longer suffice to open the last winding 11′ in the manner described hereinbefore. On the other hand, the values $A_{max}$, $\alpha_{max}$ are large enough to exclude any collision between the last winding 11′ and the stopping element 13 when the yarn storage and feed device 1 is in operation. $A_{max}$ may range from approximately twice the yarn diameter to approximately five times the yarn diameter. Angle $\alpha_{max}$ is between 5° and 30°, preferably between 10° and 15°.

For the purpose of adjusting the yarn storage and feed device 1 according to FIG. 3, the axial position of the last winding 11′ is determined, e.g. by adjusting the maximum sensor 8, depending on the yarn quality and the length of yarn required in the yarn supply S. Subsequently, the stopping element 13 is axially displaced in the direction of the double arrow 19 until the axial distance has the still admissible maximum value $A_{max}$, which reliable prevents the last winding 11′ from being opened. The yarn storage and feed device can then be put in operation.

Figure 1:
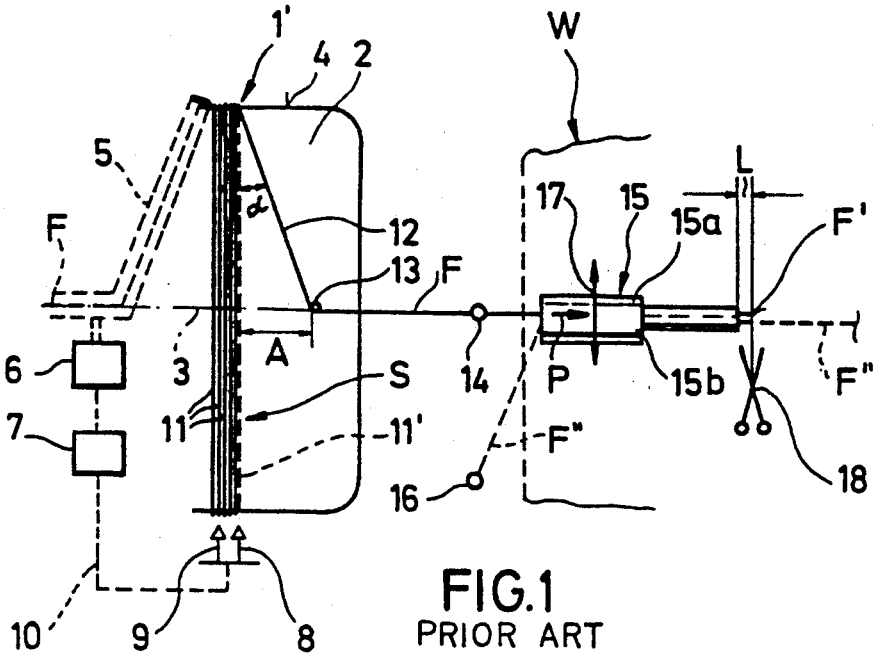
FIG.1 PRIOR ART
FIGS. 1 and 2 show a yarn storage and feed device of a known structural design in two operating phases, each of said figures showing the device in a schematic top view so as to clearly demonstrate the disadvantage to be eliminated in accordance with the present invention.
Figure 2:
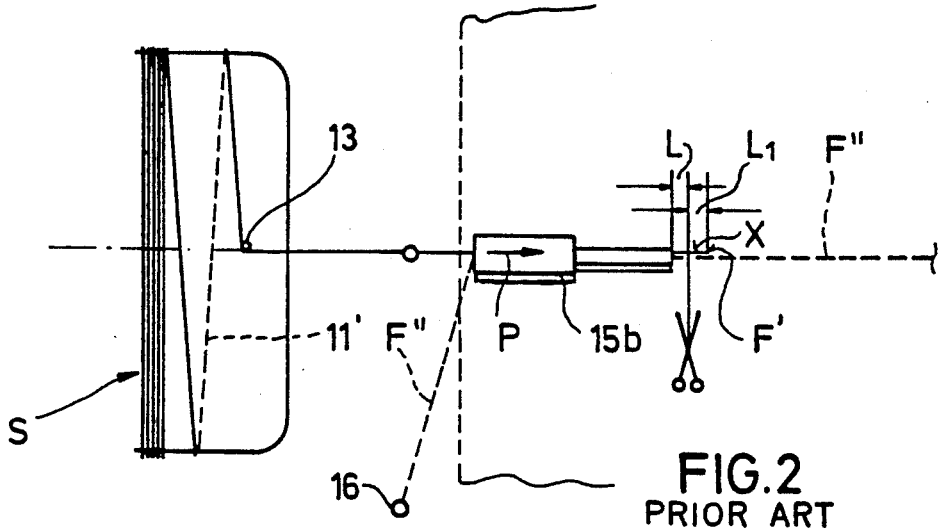
FIG.2 PRIOR ART

The yarn storage and feed device 1 according to FIG. 3 comprises the components shown in FIG. 1 and cooperates with the weaving machine, which is shown in FIG. 1, in the same manner. If the diameter of the storage surface 4 of the storage member 2 is adjustable, a single stopping element 13 will be sufficient for precisely dimensioning the length of the yarn section. If, however, the diameter of the storage surface 4 of the storage member 2 of the yarn storage and feed device 1 is not adjustable, a plurality of circumferentially spaced stopping elements 13 is provided, and it will be expedient when these stopping elements 13 are combined in an annular member, which is adapted to be adjusted in the direction of the double arrow 19.

Figure 4:
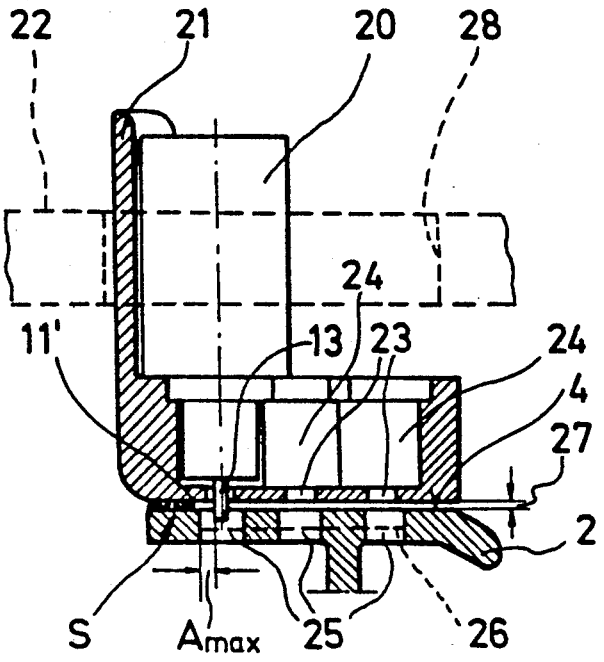
FIG. 4 shows a sectional view of a detail of FIG. 3 in a specific position of adjustment.
Figure 5:
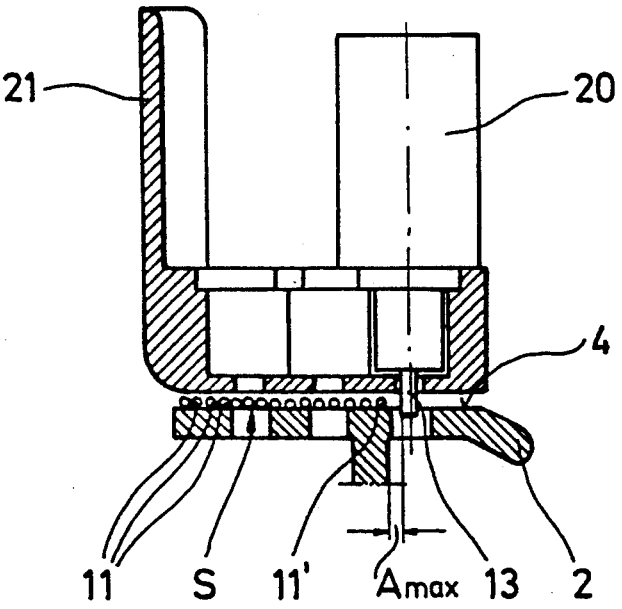
FIG. 5 shows the detail of FIG. 4 in a different position of adjustment.

In FIGS. 4 and 5, the adjustability of the stopping element 13 in the case of the embodiment of FIG. 3 is shown more clearly. The stopping element 13 plus drive elements, e.g. a magnetic coil and an armature, are accommodated in a housing 20. The housing 20 is accommodated in a stationary housing 21 at a radial distance from the storage surface 4 of the cylindrical storage member 2, said housing 20 being attached to one of several holders 24 from which holes 23 permit the stopping element 13 to move out. In FIG. 4, the stopping element 13 is located in its stopping position where it extends through a radial gap 27 between the storage surface 4 and the underside of the housing 21 and penetrates into a recessed portion 25 in the storage member 2. The yarn from the yarn supply S is stopped at the stopping element 13. The distance between the yarn supply S and the stopping element 13 is the distance having the maximum value $A_{max}$ according to FIG. 3. In the present case, the yarn supply S consists of a yarn having a very small diameter so that the last winding 11' is located at a substantial axial distance from the right end of the storage surface 4.

The storage member 2 is provided with a plurality of axially spaced recessed portions 25, which are aligned in the axial direction, so that, when the housing 20 has been repositioned and attached to a different one of the holders 24, a recessed portion 25 will always be available for the stopping element 13. In the case of the embodiment of FIGS. 4 and 5, the stopping element 13 can be adjusted in three steps. It is, however, also imaginable that the housing 20 is steplessly adjusted within the housing 21. In this case, it will be expedient to use an axial groove 26, which is open towards the storage surface 4, instead of the three recesses 25. The housing 21 is secured in position in a holding means 22.

Furthermore, it is imaginable to axially displace—instead of the housing 20—the housing 21 itself in the holding means 22, this being a possibility which exists due to the recess 28 in the holding means 22.

In FIG. 5, a thicker yarn with its windings 11 and its last winding 11' is provided in the yarn supply S. The housing 20 has been displaced to the right within the housing 21 so that the maximum value $A_{max}$ for the distance between the last winding 11' and the stopping element 13 is again observed.

The maximum sensor 8 referred to in FIG. 3 may be structurally united with the housing 20 within the housing 21 (FIGS. 4, 5) so that the displacement of the maximum sensor 8, which becomes necessary upon changing over to a different yarn quality, will simultaneously effect a corresponding displacement of the stopping element 13. The value $A_{max}$ of the distance between the stopping element and the last yarn winding 11 and the maximum sensor 8, respectively, can then be fixedly determined from the very beginning. With regard to the fact that the value $A_{max}$ should be varied in the case of different yarn qualities, it will then be expedient to additionally provide a possibility of axially displacing the stopping element 13 relative to the maximum sensor 8.

FIGS. 4 and 5 show a stepped or a stepless displacement of the stopping element in the axial direction. With regard to a sensitive displacement of the stopping element, the housing 20 may be displaceably supported in an axial guide means and adapted to be adjusted by means of a screw rod. It would also be imaginable to effect a sensitive displacement of the housing 20 and of the stopping element 13, respectively, by means of an eccentric. Appropriate scales, which are visible from outside, permit an exact examination of the respective adjustment. Another possibility of adjusting the stopping element 13 is the possibility of attaching—in a re-attachable or displaceable manner—the stopping element 13, which is inserted in a pinlike manner, to a stopping element carrier which is longer in the axial direction and which moves together with the stopping element 13 between the stopping position and the passive position thereof.

We claim:

1. A yarn storage and feed device including a generally cylindrical yarn storage means for storing thereon yarn windings wound generally concentrically about a central longitudinal axis thereof on a storage surface thereof, said yarn storage means having a forward axial end portion which permits withdrawal of yarn windings from said yarn storage means in a forward axial direction, and yarn length limiting means operable during withdrawal of yarn from said yarn storage means for causing yarn withdrawal to occur only in incremental yarn sections having a predetermined length, said yarn length limiting means including at least one stopping element and means for effecting movement of said stopping element relative to said yarn storage means into (1) a passive position in which said stopping element permits unobstructed yarn withdrawal and (2) a stopping position in which said stopping element is positioned forwardly of a forward-most yarn winding on said yarn storage means and in which said stopping element physically obstructs yarn withdrawal, the improvement comprising:

means for preventing yarn from being drawn further axially forwardly while said stopping element is obstructing yarn withdrawal, including means for causing said stopping element to be axially separated from the forward-most yarn winding by no more than a predetermined maximum axial distance whenever said stopping element assumes said stopping position, said means for effecting movement of said stopping element includes actuating elements for moving said stopping element into said stopping position, said actuating elements and said stopping element being disposed within a stationary housing which is arranged in radially spaced, opposed relationship relative to said storage surface of said yarn storage means, and said means for causing axial separation including means for permitting displacement of said stopping element axially of said yarn storage means, wherein said means for permitting axial displacement of said stopping element includes a further housing axially movably supported within said stationary housing, said stopping element and said actuating elements being disposed within said further housing.

2. A yarn storage and feed device according to claim 1, wherein said means for causing axial separation includes means for axially displacing said stopping element to, and fixing said stopping element in, a plurality of displacement positions relative to said yarn storage means.

3. A yarn storage and feed device according to claim 1, in which the angle defined between the forwardmost yarn winding and the yarn section extending from the forwardmost yarn winding to the stopping element is between 5° and 30°.

4. A yarn storage and feed device according to claim 3, wherein said angle is between 10° and 15°.

5. A yarn storage and feed device according to claim 1, wherein said predetermined maximum axial distance is in the range of from approximately twice the diameter of the yarn up to approximately five times the diameter of the yarn.

6. A yarn storage and feed device including a generally cylindrical yarn storage means for storing thereon yarn windings wound generally concentrically about a central longitudinal axis thereof on a storage surface thereof, said yarn storage means having a forward axial end portion which permits withdrawal of yarn windings from said yarn storage means in a forward axial direction, and yarn length limiting means operable during withdrawal of yarn from said yarn storage means for causing yarn withdrawal to occur only in incremental yarn sections having a predetermined length, said yarn length limiting means including at least one stopping element and means for effecting movement of said stopping element relative to said yarn storage means into (1) a passive position in which said stopping element permits unobstructed yarn withdrawal and (2) a stopping position in which said stopping element is positioned forwardly of a forward-most yarn winding on said yarn storage means and in which said stopping element physically obstructs yarn withdrawal, the improvement comprising:

means for preventing yarn from being drawn further axially forwardly while said stopping element is obstructing yarn withdrawal, including means for causing said stopping element to be axially separated from the forward-most yarn winding by no more than a predetermined maximum axial distance whenever said stopping element assumes said stopping position, wherein said storage surface of said yarn storage means has a plurality of recessed portions therein arranged in a generally linear, axially extending configuration, said means for causing axial separation including means for displacing said stopping element axially of said storage surface through a limited axial extent, and said stopping element being received within one of said recessed portions when disposed in said stopping position.

7. A yarn storage and feed device according to claim 6, in which the angle defined between the forwardmost yarn winding and the yarn section extending from the forwardmost yarn winding to the stopping element is between 5° and 30°.

8. A yarn storage and feed device according to claim 7, wherein said angle is between 10° and 15°.

9. A yarn storage and feed device according to claim 6, wherein said predetermined maximum axial distance is in the range of from approximately twice the diameter of the yarn up to approximately five times the diameter of the yarn.

10. A yarn storage and feed device including a generally cylindrical yarn storage means for storing thereon yarn windings wound generally concentrically about a central longitudinal axis thereof on a storage surface thereof, said yarn storage means having a forward axial end portion which permits withdrawal of yarn windings from said yarn storage means in a forward axial direction, and yarn length limiting means operable during withdrawal of yarn from said yarn storage means for causing yarn withdrawal to occur only in incremental yarn sections having a predetermined length, said yarn length limiting means including at least one stopping element and means for effecting movement of said stopping element relative to said yarn storage means into (1) a passive position in which said stopping element permits unobstructed yarn withdrawal and (2) a stopping position in which said stopping element is positioned forwardly of a forward-most yarn winding on said yarn storage means and in which said stopping element physically obstructs yarn withdrawal, the improvement comprising:

means for preventing yarn from being drawn further axially forwardly while said stopping element is obstructing yarn withdrawal, including means for causing said stopping element to be axially separated from the forward-most yarn winding by no more than a predetermined maximum axial distance whenever said stopping element assumes said stopping position, wherein said storage surface of said yarn storage means has a continuous, generally axially extending groove therein, said means for causing axial separation including means for effecting displacement of said stopping element axially of said storage surface through a limited axial extent, and said stopping element being received within said groove when disposed in said stopping position.

11. A yarn storage and feed device according to claim 10, in which the angle defined between the forwardmost yarn winding and the yarn section extending from the forwardmost yarn winding to the stopping element is between 5° and 30°.

12. A yarn storage and feed device according to claim 11, wherein said angle is between 10° and 15°.

13. A yarn storage and feed device according to claim 10, wherein said predetermined maximum axial distance is in the range of from approximately twice the diameter of the yarn up to approximately five times the diameter of the yarn.

14. A yarn storage and feed device including a generally cylindrical yarn storage means for storing thereon yarn windings wound generally concentrically about a central longitudinal axis thereof on a storage surface thereof, said yarn storage means having a forward axial end portion which permits withdrawal of yarn windings from said yarn storage means in a forward axial direction, and yarn length limiting means operable during withdrawal of yarn from said yarn storage means for causing yarn withdrawal to occur only in incremental yarn sections having a predetermined length, said yarn length limiting means including at least one stopping element and means for effecting movement of said stopping element relative to said yarn storage means into (1) a passive position in which said stopping element permits unobstructed yarn withdrawal and (2) a stopping position in which said stopping element is positioned forwardly of a forward-most yarn winding on said yarn storage means and in which said stopping element physically obstructs yarn withdrawal, the improvement comprising:

means for preventing yarn from being drawn further axially forwardly while said stopping element is obstructing yarn withdrawal, including means for causing said stopping element to be axially separated from the forward-most yarn winding by no more than a predetermined maximum axial distance whenever said stopping element assumes said stopping position, wherein said means for causing axial separation includes a sensor means provided exteriorly of said yarn storage means for monitoring the axial position of the forward-most yarn winding, and a housing in which said stopping element and said sensor means are disposed, said housing being supported for displacement axially of said yarn storage means.

15. A yarn storage and feed device according to claim 14, including means for permitting adjustment of an axial distance between said sensor means and said stopping element in said housing.

16. A yarn storage and feed device according to claim 14, in which the angle defined between the forwardmost yarn winding and the yarn section extending from the forwardmost yarn winding to the stopping element is between 5° and 30°.

17. A yarn storage and feed device according to claim 16. wherein said angle is between 10° and 15°.

18. A yarn storage and feed device according to claim 14, wherein said predetermined maximum axial distance is in the range of from approximately twice the diameter of the yarn up to approximately five times the diameter of the yarn.

19. A process for temporarily storing yarn and then feeding it to a textile machine, comprising the steps of:

spirally winding a continuous yarn around the circumference of the rearward portion of a stationary cylindrical storage member until a predetermined number of yarn windings have been wound around said cylindrical storage member, and then discontinuing said winding step, a portion of said yarn extending axially forwardly from said cylindrical storage member to a textile machine;

applying take-off tension to said portion of said yarn and thereby periodically freely spirally unwinding said yarn over the circumference of the forward end of said cylindrical storage member and pulling the yarn axially forwardly to the textile machine wherein the yarn is cut into predetermined lengths and is made into a textile;

periodically extending stopping means which is located on said cylindrical storage member at a position spaced axially forwardly of the location of the forwardmost winding of yarn on said cylindrical storage member from (1) a retracted position in which it does not interfere with the spiral unwinding of said yarn, into (2) an extended position in which it extends into the path of travel of the yarn as it is being unwound from said storage member, thereby stopping further unwinding and forward movement of the yarn so long as said stopping means is extended, and positioning said stopping means axially with respect to the forwardmost yarn winding on said cylindrical storage member to prevent the forwardmost yarn winding from migrating axially forwardly of said location on said cylindrical storage member for as long as said stopping means is in said extended position and take-off tension is applied to the yarn.

20. A process as claimed in claim 19, in which when said stopping means is extended, the angle defined between said forwardmost yarn winding and the yarn section extending from said forwardmost yarn winding to said stopping means is from 5° to 30°.

21. A process as claimed in claim 19, in which the axial distance between said forwardmost yarn winding and said stopping means is in the range of from approximately twice the diameter of the yarn up to approximately five times the diameter of the yarn.

22. A process as claimed in claim 19, in which when said stopping means is extended, the angle defined between said forwardmost yarn winding and the yarn section extending from said forwardmost yarn winding to said stopping means is from 10° to 15°.

* * * * *